United States Patent [19]

Kennedy

[11] 4,123,290

[45] Oct. 31, 1978

[54] CHROMIUM-CONTAINING COATING OF ENHANCED CORROSION RESISTANCE

[75] Inventor: Alexander W. Kennedy, Chardon, Ohio

[73] Assignee: Diamond Shamrock Corporation, Cleveland, Ohio

[21] Appl. No.: 789,405

[22] Filed: Apr. 21, 1977

[51] Int. Cl.[2] ..... C23F 7/26

[52] U.S. Cl. ..... 148/6.2; 148/6.16

[58] Field of Search ..... 148/6.2, 6.21, 6.16; 204/51

[56] References Cited

U.S. PATENT DOCUMENTS

| | | | |
|---|---|---|---|
| 2,898,250 | 8/1959 | Pimbley | 148/6.21 |
| 3,990,920 | 11/1976 | De Ridder et al. | 148/6.2 |

*Primary Examiner*—Ralph S. Kendall

*Attorney, Agent, or Firm*—John J. Freer

[57] ABSTRACT

A chromium-containing coating composition, also containing pulverulent metal, will provide a coating of excellent corrosion resistance when the composition contains urea as at least a part of the reducing agent, and when the composition also contains particular pH adjusting agent. The reducing agent of the composition is used in regard to the hexavalent chromium contained in the chromium portion of the composition. The pH adjusting agent should be a compound of zinc. In addition to achieving excellent corrosion resistance, resulting coatings can provide the other desirable characteristics for coated substrates, such as topcoat adhesion and formability, without deleterious effect.

10 Claims, No Drawings

CHROMIUM-CONTAINING COATING OF ENHANCED CORROSION RESISTANCE

BACKGROUND OF THE INVENTION

Chromium-containing "bonding coating" compositions for metal substrates that are applied prior to painting typically impart corrosion resistance to the surface of the substrate. Such compositions, when applied and cured on a metal substrate, exhibit excellent adherence to the substrate and offer many further desirable characteristics. These include substrate corrosion resistance, the advantage of metal formability without significant coating loss, and retention of substrate weldability. Much of the early efforts with bonding coatings involved developing combinations of hexavalent-chromium-containing substances, often supplied by chromic acid, with a wide variety of reducing agents. For example, U.S. Pat. No. 3,779,815 teaches the utility of amino acids, or of compounds containing the structure -CONH-, as reducing agents. Further, U.S. Pat. No. 3,382,081 discloses combinations of organic reducing agents that can include aliphatic dicarboxylic acids in the combination.

Coating characteristics including corrosion resistance can be augmented by including in the pre-paint coating composition a particulate metal, such a finelydivided zinc. For example, in U.S. Pat. No. 3,671,331 there are disclosed pulverulent metal-containing chromium bonding coating compositions. These contain, in addition to pulverulent metal, the hexavalent-chromium-containing substance plus reducing agent for such substance.

Because such compositions must perform a wide variety of functions, and perform them well, it has been found to be extremely difficult to upgrade a particular coating characteristic without downgrading some others. Or without downgrading the coating composition itself, as by retarding shelf life. It would be most highly desirable to enhance corrosion resistance, for example, while maintaining or improving top coat adhesion, weldability of the coated substrate and formability.

It has more recently been shown, as in U.S. Pat. No. 3,990,920, that desirable coating characteristics for these bonding coating compositions containing particulate metal, can be improved by exercising control over the pH of the coating composition. This is done by introducing a pH adjusting agent into the composition. On the one hand, the agent can enhance compositional stability. On the other hand, these formulations are becoming increasingly complex. So, desirable features must not only include those of the coating, but also those of the composition, e.g., extended compositional stability.

Improvements in coating characteristics have thus been sought without sacrifice to the desirable features of the composition itself. In such efforts, the complexity of the composition must be taken into careful consideration.

SUMMARY OF THE INVENTION

A composition has now been formulated which will provide a coating yielding excellent coated substrate corrosion resistance. This has been achieved without sacrifice to other coating characteristics, including coated substrate weldability performed by electrical resistance spot welding. Additionally, this augmented corrosion resistance has been obtained while maintaining desirable features of the composition.

Such features are now possible by incorporating into the composition, as at least a part of the reducing agent thereof, the substance urea. The urea can be used alone as the reducing agent or its benefits can be achieved when it is used in combination with other reducing substances, particularly carboxylic acids. It is also important for obtaining the full benefits of the composition that it be formulated to contain a pH adjusting agent which is a compound of zinc.

In its broadest aspect, the present invention is directed to a pulverulentmetal-containing aqueous coating composition, which composition is adapted for treating metal substrates and for providing corrosion resistance thereto. The coating composition contains hexavalent chromium, pH adjusting agent and a reducing agent for the hexavalent chromium. The corrosion resistance of resulting coated metal substrates will be enhanced by incorporating into the composition urea as at least a portion of the reducing agent. Further, the pH adjusting agent should be from the group of zinc oxides, basic zinc peroxides, zinc salts of weak acids and mixtures thereof.

In another aspect, the present invention is also directed to a chromic acid component for use in subsequently preparing a coating composition. The component, in addition to other ingredients including chromic acid, contains urea as at least a portion of the reducing agent for the chromic acid, and the above-mentioned pH adjusting agent.

DESCRIPTION OF THE PREFERRED EMBODIMENTS

The hexavalent-chromium-containing coating compositions are useful in protecting a variety of metal substrates, as has been noted hereinbefore in this art. These include typically aluminum and zinc and most particularly the ferrous substrates including iron, stainless steel or steel such as cold rolled steel.

The hexavalent chromium, referred to for convenience as the "chromic acid component," is usually supplied to the coating composition as chromic acid or its equivalent, for example, chromium trioxide or chromic acid anhydride. It is also possible to use salts to supply the hexavalent chromium. These include the calcium, barium, magnesium, zinc, cadmium and strontium dichromates. Generally, the sodium or potassium salts, if present, are used sparingly as they may detract from the coatings corrosion resistance. Generally present in minor amounts are also substances such as ammonium dichromate or compounds including trivalent chromium. Although the chromium may be present in the coating composition in an amount of as little as about 5 grams per liter, expressed as $CrO_3$, it is more typically present in an amount from about 20 to about 60 grams of $CrO_3$, per liter. Substantially concentrated amounts can be as much as 80–100 grams per liter of coating composition.

In the prior art, a very extensive number of substances have been shown to be capable of reducing hexavalent chromium. In the present invention, however, the reducing agent will be urea or the combination of reducing agents will include urea. In such combinations, it is preferred for efficient composition preparation that all reducing agents be completely water soluble. Particularly when the chromic acid component is present in the constituent in substantial amount, e.g., at a concentration above about 20 grams of $CrO_3$ per liter, the weight ratio of the $CrO_3$ to the total reducing agent can be on the order of as low as 4 to 1, although it usually is greater, e.g., 5 to 1. Hence compositions containing 80–100 grams per liter of $CrO_3$ may contain up to 20 grams per liter of urea. Typical greater ratios can be on the order of 25 to 1 to 50 to 1 or higher.

Although in combinations of reducing agents the use of any of a variety of reducing agents is contemplated, it is preferred for efficiency and economy to use organic, acidic reducing agents. Most especially these are succinic acid or the $C_5$–$C_{14}$ dicarboxylic acids as have been disclosed in U.S. Pat. No. 3,382,081. Succinic acid is an especially useful acid when used in combination with other reducing agents. Additional combinations of reducing agents can include the mono-, tri- or polycarboxylic acids that have been taught in U.S. Pat. No. 3,519,501. Since combinations of reducing agents may contain the urea in minor amount, e.g., on the order of 10–20 weight percent, basis total agent weight, the urea may be present in the coating composition in an amount of as little as about 0.1 gram per liter.

Substantially all of the coating compositions contemplated in the present invention are simply water-based for economy. But, for additional substances for supplying minor amounts of liquid medium, there have been taught, as in U.S. Pat. No. 3,437,532, blends of chlorinated hydrocarbons and tertiary alcohols including tertiary butyl alcohol.

Another key component for the coating composition is the zinc compound pH adjusting agent. Such agent will be capable of adjusting the pH of an aqueous chromic acid solution having a pH of less than about 0.8. Further, such agent should have sufficient water solubility in the aqueous chromic acid solution to provide for pH adjustment. Since the reduction of the hexavalent chromium should be essentially or completely the function of the reducing agent, it is contemplated to use a pH adjusting agent that may have, at most, only a minor direct affect in regard to reduction of the hexavalent chromium under acidic conditions. The agent will be a basic zinc oxide or basic zinc peroxide, or a zinc salt of a weak acid, as well as mixtures of such compounds. Representative of such pH adjusting agents are zinc carbonate, zinc acetate, zinc hydroxide, zinc oxide, zinc peroxides, zinc oxalate, tertiary zinc phosphate as well as mixtures thereof. For efficiency and economy, zinc oxide is preferred.

The chromic acid and the pH adjustment agent are typically initially present together in a precursor constituent. This chromic acid component will initially have, from the acid, for example, a pH of 1 or blow, e.g., less than 0.8. The reducing agent may also be present in such component. The amount of pH adjusting agent will be sufficient to elevate the pH of the precursor constituent to above 1, and typically to a pH within the range of 1.5–4, but most always not above about 5. In usual practice then, the agent is blended into the precursor constituent to provide for adjusted pH of the constituent of above about 1 and up to about 5, inclusive. The amount of agent actually used will, of course, depend upon the concentration of the chromic acid in the precursor constituent, and, additionally, for example, on the concentration of reducing agent and on the neutralizing strength of the particular pH adjusting agent. It is most practical to measure the precursor constituent pH during adjustment for considering the amount of pH adjustment agent to be added. Such adjusted pH precursor constituents have been discussed for example in U.S. Pat. No. 3,970,482.

An additional component that will be present in the coating composition is the pulverulent metal. The presence of pulverulent metal in such compositions has been previously discussed in U.S. Pat. No. 3,671,331. Most usually, the particulate metal will be pulverulent zinc, although pulverulent aluminum is contemplated as well as blends, including pulverulent aluminum and particulate zinc and alloys thereof.

The particulate metal portion of the coating composition should be present in an amount sufficient to provide at least about 50 grams per liter of the pulverulent metal. There further should be sufficient of the chromium component to provide in the coating composition a weight ratio of chromium, expressed as $CrO_3$ to pulverulent metal of not substantially less than about 0.08:1. A ratio of less than that may not provide sufficient chromium in the subsequent coating to achieve augmented bonding of the pulverulent metal to the metal substrate.

On the other hand, a ratio greater than about 0.4:1 may detract from the most enhanced corrosion resistance for the coated substrate. Thus, for an exemplary composition containing about 200 grams per liter of pulverulent metal, the chromium component should be sufficient to provide in the coating composition between about 15–80 grams of $CrO_3$ per liter of coating composition.

The coating composition may additionally contain a variety of additives. Such include thickening agents, most typically the zanthan gum hydrophilic colloids. Additional thickeners include other gum thickeners which can be used in mixture, especially with the zanthan gum. Cellulose ethers may also be employed in thickening. Additional agents include wetting agents and suspending agents and the like. These may also be surface active, and those typically used may be hydroxyl-containing hydrocarbon ethers. Such ethers more particularly include the alkyl ethers of alkylene glycols, such a butyl ether or propylene glycol and the oxyalkyl ethers of alkylene glycols. Some of these agents, together with the particulate metal, may be preblended. Such a preblended composition may then be mixed with the abovementioned precursor composition to form the final coating composition. Preblended compositions of zinc flake and thickener have been discussed, for example, in U.S. Pat. No. 3,940,280.

These other compounds may further include inorganic salts often typically employed in the metal coating art for imparting some corrosion resistance or enhancement in corrosion resistance for metal surfaces. Such materials include zinc chloride, magnesium chloride, chromates, and various molybdates, and these are all preferably avoided, but if present, are most unusually employed in the liquid composition in a total maximum amount of less than 5 grams per liter.

For the metal substrates containing applied coating, the preferred temperature for the subsequent heating, which may not occur until after topcoating and which is also often referred to as curing and which may be preceded by drying such as air drying, is within the range from about 400° F. at a pressure of 760 mm. Hg up to not essentially above about 1,000° F. Such an elevated substrate temperature may be attained by preheating the metal prior to application of the liquid composition. However, such curing temperatures do not often exceed a temperature within the range of about 450° F.–700° F. At the elevated curing temperatures the heating can be carried out in as rapidly as about 0.2 second or less but is often conducted for several minutes at a reduced temperature.

Before starting the treatment of the present invention it is, in most cases advisable to remove foreign matter from the metal surface by thoroughly cleaning and degreasing. Degreasing may be accomplished with known agents, for instance, with agents containing sodium metasilicate, caustic soda, carbon tetrachloride, trichlorethylene, and the like. Commercial alkaline cleaning compositions which combine washing and mild abrasive treatments can be employed for cleaning, e.g., an aqueous trisodium phosphate-sodium hydroxide cleaning solution. In addition to cleaning, the substrate may undergo cleaning plus etching.

After drying the resulting coated substrate, which can include heating, such can be further topcoated with any suitable paint, i.e., a paint primer, including electrocoating primers and weldable primers such as the zinc-rich primers that may be typically applied before electrical resistance welding. For example, it has already been shown in U.S. Pat. No. 3,671,331 that a primer topcoating containing a particulate, electrically conductive pigment, such as zinc, is highly servicable for a metal substrate that is first treated with a bonding coating composition which itself contains a pulverulent metal such as finely divided zinc, with the zinc being supplied in a prepaint coating from a composition containing hexavalent-chromium-providing substance, such as chromic acid, and a reducing agent for the substance. A representative weldable primer containing an electrically conductive pigment plus binder in a vehicle has been disclosed for example in U.S. Pat. No. 3,110,691, teaching a suitable zinc paste paint composition for application to a metallic surface prior to welding. Other topcoating formulations of considerable interest, although applicable to a metal substrate without weldability in mind, contain particulate zinc along with zinc oxide. Other topcoating systems of special consideration have been referred to in the prior art as "silicate coatings." These may be aqueous systems containing a finely divided metal such as powdered zinc or aluminum, lead, titanium, iron plus a water soluble or water dispersible binder. Representative of the binders are alkali metal silicates, inorganic silicate esters, or a colloidal silica sol.

Other topcoating paints may contain pigment in a binder or can be unpigmented, e.g., generally cellulose lacquers, rosin varnishes, and oleoresinous varnishes, as for example tung oil varnish. The paints can be solvent reduced or they may be water reduced, e.g., latex or water-soluble resins, including modified or soluble alkyds, or the paints can have reactive solvents such as in the polyesters or polyurethanes. Additional suitable paints which can be used include oil paints, including phenolic resin paints, solvent-reduced alkyds epoxys, acrylics, vinyl, including polyvinyl butyral and oil-wax-type coatings such as linseed oil-paraffin wax paints.

The following examples show ways in which the invention has been practiced but should not be construed as limiting the invention. In the examples, the following procedures have been employed.

PREPARATION OF TEST PANELS

Unless otherwise specifically described, test panels are typically 4 × 8 cold rolled, low carbon steel panels. They are prepared for coating by first scrubbing with a cleaning pad which is a porous, fibrous pad of synthetic fiber impregnated with an abrasive. Thereafter, the scrubbed panels are immersed in a cleaning solution typically containing chlorinated hydrocarbon and maintained at about 180° F., or containing 1–5 ounces, per gallon of water, of a mixture of 25 weight percent tripotassium phosphate and 75 weight percent potassium hydroxide. This alkaline bath is maintained at a temperature of about 150°–180° F. Following the cleaning, the panels are rinsed with warm water and preferably dried.

PRIMER TOPCOATING AND APPLICATION

When pre-painted panels are primer topcoated, the primer used is a commercially available primer which is a zinc-rich weldable primer having a weight per gallon of about 15.2 lbs., a solids volume of about 27%, and containing about 62 weight percent of nonvolatiles. The binder component is prepared from a high molecular weight epoxy resin. The primer has a typical viscosity of about 80 seconds as measured on a No. 4 Ford cup. This primer is typically applied to pre-painted panels by drawing the primer down over the panel with a draw bar to provide a smooth, uniform primer coat, generally of about 0.5 mil thickness. Resulting coated panels are usually cured for about 3½–4 minutes in an oven at about 500°–550° F.

ADHESION/CORROSION TEST

The corrosion resistance of the coating system on the panel under extreme conditions can then be measured by first subjecting the coating to an adhesion test. In this test, cleaned and coated panels, cleaned in a manner such as above-described, are pressed with a cup-like impression.

In the test, more specifically, there is used a cup ductility machine of the motor driven hydraulically actuated type. In general, an unlubricated, coated test panel is held firmly between male and female dies, by grippers at the perimeter of the die covering. The coated side of the panel faces the female die. A ball is forced in the aperture of the male die, resulting in the pushing and stretching of part of the panel into the cup-like impression of the female die. The test employs a female die cup diameter of 1 inch, a ball diameter of ⅞-inch, and provides a cup depth, from the under surface of the flat panel to the under surface of the cup, of 0.3-inch. The resulting panel is then subjected to the below described corrosion resistance test.

CORROSION RESISTANCE TEST (ASTM B-117) AND RATING

Corrosion resistance of coated parts is measured by means of the standard salt spray (fog) test for paints and varnishes ASTM B-117. In this test, the parts are placed in a chamber kept at constant temperature where they are exposed to a fine spray (fog) of a 5% salt solution for specified periods of time, rinsed in water and dried. The extent of corrosion on the test parts is determined by comparing parts one with another, and all by visual inspection. Where test panels are scribed, the scribing is performed before corrosion resistance testing by cutting an "X" configuration on the face of the panel. The scribe lines are made through the coatings to expose the underlying metal. The extent of corrosion along the scribe lines is also made by visual inspection and through comparison among test panels.

In the following examples, and unless otherwise specified, the efficacy of the corrosion resistance obtained on coated panels is, in part, quantitatively evaluated on a numerical scale from 0 to 10. The panels are visually inspected and compared with one another and the system is used for convenience in the reviewing of results. In the rating system the following numbers are used to cover the following results:

(0) retention of film integrity, no red rust;
(8) initial coating degradation, pinpoints of red rust;
(6) less than 3% red rust basis total surface area of the part;
(4) 3 to 10% red rust, i.e., a significant amount of rust;
(2) 10 to 25 percent surface area red rust;
(0) greater than 25 percent red rust.

EXAMPLE 1

There is formulated, with blending, a "Control" pre-paint coating composition for comparative use and containing 20 grams per liter of chromic acid, 3.33 grams per liter of succinic acid, 1.67 grams per liter of succinimide, 1.5 grams per liter of xanthan gum hydrophilic colloid, which is a heteropolysaccharide prepared from the bacteria specie *Xanthamonas campestris* and has a molecular weight in excesses of 200,000. Additionally, this Control composition contains 1 milliliter of formalin, 7 grams per liter of zinc oxide, 120 grams per liter of zinc dust having an average particle size of about 5 microns and having all particles finer than 16 microns, and 1 drop per liter of a wetter which is a nonionic, modified polyethoxide adduct having a viscosity in centipoises at 25° C. of 180 and a density of 25° C. of 8.7 lbs. per gallon. After mixing all of these constituents, this control composition is then ready for coating test panels.

For further test purposes, there is subsequently blended together a separate "New" composition representative of the present invention. With the two compositions, the only difference is that the New composition contains 0.8 gram per liter of urea in place of the 1.67 grams per liter of succinimide.

Panels, prepared as described hereinabove, are dip coated, some into freshly prepared Control coating composition and some into the freshly prepared New pre-paint coating composition. Panels are removed from these compositions and excess composition is drained from the panels. If the panels are not further coated, they are then baked for 3.5 minutes in an oven at an oven temperature of 500° F.

Some panels, selected for topcoating, are baked for one minute in the oven at the 500° F. temperature. These panels are then topcoated with the primer, and the primer cured, all in the manner as described hereinbefore. Some of these topcoated panels, as well as some not topcoated, are then selected for testing in the above described corrosion resistance (salt spray) test. All panels are scribed before testing. The results of the corrosion resistance testing are reported in the table and are for the scribe lines only.

In the manner as described herein above, panels are quantitatively evaluated for the scribe lines on a numerical scale. This is done by visual inspection, comparing panels with one another and employing a rating system using the following numbers that cover the following results:

(10) no red rust in the scribe; (8) up to 30% red rust in the total scribe and initial run-off from the intersection of the scribe lines;
(6) up to 80% red rust in the scribe with run-off from up to 50% of the scribe lines;
(4) Complete red rust of the scribe with moderate to heavy run-off from all portions of the scribe; and
(2) Heavy run-off from all portions of the scribe lines.

Coating weights for panels, as chromium, and not as $CrO_3$, and as zinc, both being in weights in milligrams per square foot of coated substrate, are listed for panels coated with both the Control and the New composition in the table below. Such weights are determined by a Porta-Spec x-ray fluorescence spectroscope manufactured by Pitchford Corporation. The lithium fluoride analyzing crystal is set at the required angle to determine chromium, and at the required angle to determine zinc. The instrument is initially standardized with coatings containing known amounts of these elements. The machine is adapted with a counter unit and the count for any particular coating is translated into milligrams per square foot by comparison with a preplotted curve.

TABLE 1

| Pre-Paint Coating | Pre-Paint Coating Weight* Cr | Zinc | Topcoating | 240 Hours Salt Spray Corrosion For Scribe Only |
|---|---|---|---|---|
| Control | 31.5 | 365 | No | 1 |
| Control | 33.5 | 380 | No | 1 |
| New | 26.5 | 470 | No | 10 |
| New | 26.0 | 450 | No | 10 |
| Control | — | — | Yes | 3** |
| New | — | — | Yes | 10** |

*In milligrams per square foot determined after testing; no determination for topcoated panels.
**Average of two panels.

EXAMPLE 2

The Control pre-paint coating composition described in Example 1 is also used herein for comparative purposes, except that it is at a 160% concentration level, basis a 100% concentration level for Example 1. Thus for example the composition contains 32 grams per liter of chromic acid. The "New" composition used herein is the same as that used in Example 1, but it is also at the 160% concentration level. The exceptions to this 60% increase for each composition are that they each contain 2 grams per liter of the Xanthan gum, 2 milliliters of formalin and 1 drop of wetter.

Steel is coated on a two roll, reverse roll coater, coil coating line having a urethane covered applicator roll and a steel pick-up roll. The coil steel is aluminumkilled, drawing quality steel that is 4 inches wide by 0.035 inch thick. The steel is hot alkali spray cleaned, with abrasive brushing, all in line, followed by in line fresh water rinsing and blowing dry.

The coated steel is cured in a coil coating oven to a peak metal temperature of about 320° F. and the panels are then topcoated. The coated steel is topcoated with the reverse roll coater, on the coating line, and is then cured in the coil coating oven to a peak metal temperature of about 250° F. Test panels are then cut from the steel. All panels are next subjected to the hereinbefore discussed adhesion/corrosion test. In this test the panels are first deformed with the cup-like or dome impression. They are then subjected to the corrosion resistance, or salt spray, portion of the test.

In reviewing tested panels, only the dome portion of the coated panel is considered. To pass the test, the dome portion of the panel must exhibit less than 10% red rust. In the Table below, the results are listed for the number of panels, as a percentage of the total panels of the group, that passed the minimum criterion, i.e., exhibit less than 10% red rust.

TABLE 2

| Salt Spray % Corrosion on Dome - 360 Hours | | |
|---|---|---|
| Composition Type | Control | New |
| Number of Panels | 36 | 32 |
| Number Passing Specification | 72% | 100% |

EXAMPLE 3

The Control composition of Example 1 is again prepared. Also, the "New" composition of Example 1 is prepared. Panels are coated and the coating cured as hereinbefore described and some panels are topcoated with a weldable primer, also as described hereinabove. Prior to topcoating, coating weights of the pre-paint coatings for the panels are determined; the results, for chromium and zinc in milligrams per square foot of coated substrate, are listed in the Table below.

Pre-paint coated as well as topcoated panels are then subjected to the corrosion resistance test. The duration of this test, as well as the results thereof, are listed in the Table below. In the Table the test results are reported in accordance with the rating system described hereinabove in the introduction to the examples. They are results for the face of the panels.

TABLE 3

| Pre-Paint Coating | Pre-Paint Coating Weight* Cr | Zinc | Topcoating | 240 Hours Salt Spray Corrosion For Scribe Only |
|---|---|---|---|---|
| Control | 42.5 | 555 | No | 0 |
| Control | 39.5 | 535 | No | 0 |
| New | 36.5 | 545 | No | 10 |
| Control | 34.0 | 445 | Yes | 3.4** |
| New | 29.5 | 420 | Yes | 9.0** |

*In milligrams per square foot.
**Average of five panels.

EXAMPLE 4

The "Control" pre-paint coating composition, which has been described in Example 1, is employed herein for comparative use. There is then formulated the "New" coating composition of Example 1. Panels are coated and cured as described hereinabove, but do not all have the same coating weight, and are then topcoated with the primer, and in the manner, described hereinbefore. These topcoated panels are then cured in an electric oven for times ranging from 3¼ to 4½ minutes. Panel temperatures achieved during cure are in the range of 455°-510° F. Panels are then subjected to the above described corrosion resistance (salt spray) test. Coating weights for panels, as chromium and zinc weights in milligrams per square foot of coated substrate, are listed for both the Control and the New composition in the table below. The results of the corrosion resistance testing are also reported in the table and are for the face of panels, using the rating scale described hereinbefore in the introduction to the examples.

TABLE 4

| Pre-Paint Coating | Pre-Paint Coating Weight* Cr | Zinc | 144 Hours Salt Spray Corrosion For Panel Face* |
|---|---|---|---|
| Control | 45.5 | 615 | 2.2 |
| New | 27.0 | 330 | 7.8 |

TABLE 4-continued

| Pre-Paint Coating | Pre-Paint Coating Weight* Cr | Zinc | 144 Hours Salt Spray Corrosion For Panel Face* |
|---|---|---|---|
| New | 39.5 | 535 | 8.7 |

*Average of six panels.
**In milligrams per square foot.

I claim:

1. In a pulverulent-metal-containing aqueous coating composition containing pulverulent zinc, aluminum, or their mixtures, which composition is adapted for treating metal substrates and for providing corrosion resistance thereto, said coating composition containing hexavalent chromium, pH adjusting agent and a reducing agent for said hexavalent chromium, and with the weight ratio of chromium, expressed as $CrO_3$, to reducing agent being from about 4:1 to about 50:1, the improvement for enhancing the corrosion resistance of resulting coated metal substrates which comprises incorporating 0.1-20 grams per liter of urea into said composition as at least a portion of said reducing agent, and with the proviso that said pH adjusting agent is selected from the group consisting of basic zinc oxides, basic zinc peroxides, zinc salts of weak acids, and mixtures thereof, said agent having sufficient water solubility in said composition to provide for pH adjustment.

2. The composition of claim 1 wherein urea forms a portion of reducing agent and the balance of said agent is supplied by an organic, acid substance.

3. The composition of claim 2 wherein said balance of reducing agent comprises a substance containing the carboxyl group.

4. The composition of claim 1 wherein said pH adjusting agent is capable of adjusting the pH of an aqueous chromic acid solution having a pH of less than about 0.8.

5. The composition of claim 4 wherein said pH adjusting agent is selected from the group consisting of zinc oxide, zinc carbonate, zinc hydroxide, zinc peroxides, zinc acetate, zinc oxalate, tertiary zinc phosphate and mixtures thereof.

6. The composition of claim 1 wherein said reducing agent comprises urea plus dicarboxylic acid, said said pH adjusting agent is zinc oxide.

7. A chromic acid component for use in subsequently preparing a coating composition, said coating composition containing pulverulent metal and providing an enhanced, corrosion-resistant coating on a resulting coated metal substrate, said component comprising aqueous medium, chromic acid, pH adjusting agent and reducing agent for said chromic acid containing 0.1-20 grams per liter of urea as at least a portion thereof, with the weight ratio of chromium, expressed as $CrO_3$, to reducing agent in said component being from about 4:1 to about 50:1, and with the proviso that said pH adjusting agent is selected from the group consisting of basic zinc oxides, basic zinc peroxide, zinc salts of weak acids, and mixtures thereof, said agent having sufficient water solubility in said composition to provide for pH adjustment.

8. The chromic acid component of claim 7 wherein said reducing agent comprises urea and organic, acidic substance.

9. The chromic acid component of claim 7 wherein said pH adjusting agent is capable of adjusting the pH of a chromic acid solution having a pH of less than about 0.8 and is selected from the group consisting of zinc oxide, zinc carbonate, zinc hydroxide, zinc acetate, zinc peroxides, zinc oxalate, tertiary zinc phosphates and mixtures thereof.

10. The chromic acid component of claim 7 wherein said reducing agent comprises urea plus dicarboxylic acid, and said pH adjusting agent is zinc oxide.

* * * * *